US010111018B2

(12) United States Patent
Neumeyer

(10) Patent No.: US 10,111,018 B2
(45) Date of Patent: Oct. 23, 2018

(54) PROCESSOR-READABLE MEDIUM, APPARATUS AND METHOD FOR UPDATING HEARING AID

(71) Applicant: III Holdings 4, LLC, Wilmington, DE (US)

(72) Inventor: Frederick Charles Neumeyer, Austin, TX (US)

(73) Assignee: III Holdings 4, LLC, Wilmington, DE (US)

( * ) Notice: Subject to any disclaimer, the term of this patent is extended or adjusted under 35 U.S.C. 154(b) by 0 days.

(21) Appl. No.: 15/268,470

(22) Filed: Sep. 16, 2016

(65) Prior Publication Data

US 2017/0142530 A1 May 18, 2017

Related U.S. Application Data

(63) Continuation of application No. 13/782,710, filed on Mar. 1, 2013, now Pat. No. 9,479,876.

(60) Provisional application No. 61/621,234, filed on Apr. 6, 2012.

(51) Int. Cl.
*H04R 25/00* (2006.01)

(52) U.S. Cl.
CPC ..... *H04R 25/558* (2013.01); *H04R 25/30* (2013.01); *H04R 25/35* (2013.01); *H04R 25/554* (2013.01); *H04R 25/70* (2013.01); *H04R 2225/41* (2013.01)

(58) Field of Classification Search
CPC ..... H04R 25/00; H04R 25/30; H04R 25/305; H04R 25/43; H04R 25/50; H04R 25/502; H04R 25/505; H04R 25/55; H04R 25/554; H04R 25/556; H04R 25/558; H04R 25/70; H04R 25/35; H04R 2225/00; H04R 2225/39; H04R 2225/41; H04R 2225/55; H04R 2225/81; H04R 2225/61
USPC ..... 381/58, 60, 312, 314, 315
See application file for complete search history.

(56) References Cited

U.S. PATENT DOCUMENTS

| | | | | |
|---|---|---|---|---|
| 4,759,070 A * | 7/1988 | Voroba | A61B 5/12 381/328 |
| 4,947,432 A | 8/1990 | Topholm | |
| 4,972,487 A | 11/1990 | Mangold et al. | |
| 5,721,783 A | 2/1998 | Anderson | |
| 5,785,661 A * | 7/1998 | Shennib | H04R 25/70 600/559 |
| 6,741,712 B2 | 5/2004 | Bisgaard et al. | |
| 7,200,237 B2 | 4/2007 | Zhang et al. | |

(Continued)

FOREIGN PATENT DOCUMENTS

| | | |
|---|---|---|
| WO | 2008071236 A2 | 6/2008 |
| WO | 2009001559 A1 | 12/2008 |

OTHER PUBLICATIONS

"Good Practice Guidance for Adult Hearing Aid Fittings and Services," prepared for International Society of Audiology, Nov. 2004, 8 pages. Exhibit 1012, Case IPR2017-00781.

(Continued)

*Primary Examiner* — Matthew Eason
*Assistant Examiner* — Sabrina Diaz
(74) *Attorney, Agent, or Firm* — Perkins Coie LLP

(57) ABSTRACT

A system for updating a hearing aid by providing an update to a hearing aid to configure the hearing aid for an acoustic environment with a sound profile different than a physical environment a user is currently located in with an acoustic sample representative of the acoustic environment.

16 Claims, 3 Drawing Sheets

(56) References Cited

U.S. PATENT DOCUMENTS

| | | | | |
|---|---|---|---|---|
| 7,519,194 | B2 | 4/2009 | Niederdränk et al. | |
| 7,933,419 | B2 | 4/2011 | Roeck et al. | |
| 8,077,891 | B2 | 12/2011 | Hasler et al. | |
| 8,280,369 | B1 | 10/2012 | Reeves et al. | |
| 8,379,871 | B2 | 2/2013 | Michael et al. | |
| 8,406,442 | B2 | 3/2013 | Ribic et al. | |
| 8,457,335 | B2 | 6/2013 | Imamura et al. | |
| 8,526,649 | B2 | 9/2013 | Foo et al. | |
| 8,588,442 | B2 | 11/2013 | Schmitt et al. | |
| 8,611,570 | B2 | 12/2013 | Neumeyer et al. | |
| 8,649,538 | B2 | 2/2014 | Apfel et al. | |
| 8,654,999 | B2 | 2/2014 | Mindlin et al. | |
| 8,761,421 | B2 | 6/2014 | Apfel et al. | |
| 8,787,603 | B2 | 7/2014 | Fichtl et al. | |
| 8,810,392 | B1 | 8/2014 | Teller et al. | |
| 8,965,017 | B2 | 2/2015 | Bryant et al. | |
| 9,191,756 | B2 | 11/2015 | Neumeyer et al. | |
| 9,479,876 | B2 | 10/2016 | Neumeyer | |
| 2003/0008659 | A1 | 1/2003 | Waters et al. | |
| 2003/0059076 | A1 | 3/2003 | Martin et al. | |
| 2003/0215105 | A1 | 11/2003 | Sacha et al. | |
| 2004/0059446 | A1 | 3/2004 | Goldberg et al. | |
| 2005/0036637 | A1 | 2/2005 | Janssen et al. | |
| 2006/0182294 | A1 | 8/2006 | Grasbon et al. | |
| 2007/0098195 | A1 | 5/2007 | Holmes et al. | |
| 2007/0255435 | A1* | 11/2007 | Cohen | H04R 1/1016 700/94 |
| 2009/0047994 | A1 | 2/2009 | Sommer et al. | |
| 2009/0154741 | A1* | 6/2009 | Woods | H04R 25/70 381/312 |
| 2010/0027822 | A1 | 2/2010 | Dietz et al. | |
| 2010/0255782 | A1 | 10/2010 | Klemmensen et al. | |
| 2010/0273452 | A1 | 10/2010 | Rajann et al. | |
| 2010/0290654 | A1 | 11/2010 | Wiggins et al. | |
| 2011/0176697 | A1 | 7/2011 | Apfel et al. | |
| 2012/0183165 | A1 | 7/2012 | Foo et al. | |
| 2012/0213393 | A1 | 8/2012 | Foo et al. | |
| 2012/0219159 | A1 | 8/2012 | Burk et al. | |
| 2012/0237064 | A1* | 9/2012 | Garratt | H04R 25/70 381/314 |
| 2013/0266165 | A1 | 10/2013 | Neumeyer et al. | |
| 2015/0156596 | A1 | 6/2015 | Bryant et al. | |

OTHER PUBLICATIONS

American Heritage Dictionary of the English Language, 5th edition, 2011, p. 1652. Exhibit 1011, Case IPR2017-00783.

Aug. 16, 2013 Response to Jun. 4, 2013 Office Action in Prosecution History of U.S. Pat. No. 8,611,570, 9 pages. Exhibit 1004, Case IPR2017-00367.

Barron's Dictionary of Computer and Internet Terms, 11th edition, 2013, p. 457. Exhibit 1012, Case IPR2017-00783.

Certified English language translation of German Patent Publication No. DE19542961, May 15, 1997, 16 pages. Exhibit 1009 Case IPR2017-00781.

Certified English language translation of WIPO Patent Publication No. WO2009/001559 to Imamura et al., Dec. 31, 2008, 79 pages. Exhibit 1006, Case IPR2017-00367.

Consumer Reports "Hear Well in a Noisy World—features at a glance," Jul. 2009, 2 pages. Exhibit 1009, Case IPR2017-00414.

Declaration of Dr. Les Atlas, Exhibit 1008, Case IPR2017-00781. Jan. 26, 2017, 145 pages.

Declaration of Dr. Robert E. Morley, Jr., Exhibit 1002, Case IPR2017-00496. Dec. 21, 2016, 87 pages.

Declaration of Dr. Robert K. Morrow, Exhibit 1003, Case IPR2017-00783. Jan. 27, 2017, 85 pages. Exhibit 1003, Case IPR2017-00783.

Declaration of Dr. Sayfe Kiaei, Exhibit 1002, Case IPR2017-00367. Dec. 4, 2016, 102 pages.

Declaration of Les Atlas PhD, Exhibit 1003 Case IPR2017-00414. Dec. 6, 2016, 111 pages.

Dillon et al., "The trainable hearing aid: What will it do for clients and clinicians?" The Hearing Journal, vol. 59, No. 4, Apr. 2006, 6 pages. Exhibit 1014, Case IPR2017-00781.

Jul. 10, 2013 Response to May 30, 2013 Office Action in Prosecution History of U.S. Pat. No. 8,761,421, 13 pages. Exhibit 1008, Case IPR2017-00496.

Kasoff, B., "A Closer Look: The Evolution of the Smart Phone," Sep. 19, 2014, 2 pages. <blog.wipp.org/2014/09/a-closer-look-the-evolution-of/> Exhibit 1016, Case IPR2017-00783.

Keidser, Gitte et al., "Variation in preferred gain with experience for hearing-aid users," 2008, International Journal of Audiology 47:10, 621-635. Exhibit 1013, Case IPR2017-00781.

Mar. 1, 2013 Response to Dec. 12, 2012 Office Action in Prosecution History of U.S. Pat. No. 8,761,421, 22 pages. Exhibit 1006, Case IPR2017-00496.

Martin, T. "The evolution of the srnartphone," Jul. 29, 2014, 20 pages. <pocketnow.com/2014/07/28/the-evolution-of-the-smartphone> Exhibit 1014, CaseIPR2017-00783.

Mukherjee, S., "Smartphone Evolution: From IBM Simon to Samsung Galaxy S3," May 8, 2012, p. 3. <ibtimes.com/smartphone-evolution-ibm-simon-samsung-galaxy-s3-697340> Exhibit 1015. Case IPR2017-00783.

Prosecution History of U.S. Pat. No. 8,649,538 to Apfel et al., 166 pages; patent application filed Feb. 8, 2011. Exhibit 1002, Case IPR2017-00414.

Prosecution History of U.S. Pat. No. 8,654,999 to Mindlin et al., 194 pages; patent application filed Apr. 12, 2011. Exhibit 1002, Case IPR2017-00781.

Prosecution History of U.S. Pat. No. 9,191,756 to Neumeyer et al., 71 pages; patent application filed Dec. 7, 2012. Exhibit 1002, Case IPR2017-00783.

Rodriguez, Gary P. et al. "Preferred Hearing Aid Response Characteristics Under Acoustic and Telecoil Coupling Conditions," American Journal of Audiology55, Nov. 1993, 5 pages. Exhibit 1011, Case IPR2017-00414.

Sager, I., "Before IPhone and Adroid Came Simon, the First Smartphone," Jun. 29, 2012, 3 pages. <bloomberg.com/news/articles/2012-06-29/before-iphone-and-android-came-simon-the-first-smartphone> Exhibit 1013, Case IPR2017-00783.

United States Patent and Trademark Office, Dec. 12, 2012 Office Action from Prosecution History of U.S. Pat. No. 8,761,421, 19 pages. Exhibit 1003, Case IPR2017-00496.

United States Patent and Trademark Office, Jun. 4, 2013 Office Action from Prosecution History of U.S. Pat. No. 8,611,570, 6 pages. Exhibit 1003, Case IPR2017-00367.

United States Patent and Trademark Office, May 30, 2013 Office Action from Prosecution History of U.S. Pat. No. 8,761,421, 19 pages. Exhibit 1007, Case IPR2017-00496.

United States Patent and Trademark Office, Patent Trial and Appeal Board, *K/S HIMPP* v. *III Holdings 4, LLC*, Case IPR2017-00367 (U.S. Pat. No. 8,611,570), Petition for Inter Partes Review, Dec. 6, 2016, 81 pages.

United States Patent and Trademark Office, Patent Trial and Appeal Board, *K/S HIMPP* v. *III Holdings 4, LLC*, Case IPR2017-00414 (U.S. Pat. No. 8,649,538), Petition for Inter Partes Review, Dec. 6, 2016, 84 pages.

United States Patent and Trademark Office, Patent Trial and Appeal Board, *K/S HIMPP* v. *III Holdings 4, LLC*, Case IPR2017-00496 (U.S. Pat. No. 8,761,421), Petition for Inter Partes Review, Dec. 21, 2016, 91 pages.

United States Patent and Trademark Office, Patent Trial and Appeal Board, *K/S HIMPP* v. *III Holdings 4, LLC*, Case IPR2017-00781 (U.S. Pat. No. 8,654,999), Petition for Inter Partes Review of claims 1-9 and 16-19, Jan. 27, 2017, 69 pages.

United States Patent and Trademark Office, Patent Trial and Appeal Board, *K/S HIMPP* v. *III Holdings 4, LLC*, Case IPR2017-00782 (U.S. Pat. No. 8,654,999), Petition for Inter Partes Review of claims 10-15 and 20, Jan. 27, 2017, 56 pages.

United States Patent and Trademark Office, Patent Trial and Appeal Board, *K/S HIMPP* v. *III Holdings 4, LLC*, CaseIPR2017-00783 (U.S. Pat. No. 9,191,756), Petition for Inter Partes Review, Jan. 27, 2017, 79 pages.

Valente, Michael, "Guideline for Audiologic Management of the Adult Patient," Audiology Online 2016, Oct, 30, 2006, 8 pages. Exhibit 1011, Case IPR2017-00781.

(56) References Cited

OTHER PUBLICATIONS

Widrow, Bernard et al. "Microphone Arrays for Hearing Aids: An Overview," Journal of Speech Communication, Jan. 2003, pp. 139-146. Exhibit 1010, Case IPR2017-00414.
United States Patent and Trademark Office, Final Office Action, U.S. Appl. No. 13/782,710, dated Dec. 2, 2015, 15 pages.
United States Patent and Trademark Office, Final Office Action, U.S. Appl. No. 13/782,710, dated Oct, 23, 2014, 16 pages.
United States Patent and Trademark Office, Final Office Action, U.S. Appl. No. 14/611,944, dated Nov. 4, 2016, 21 pages.
United States Patent and Trademark Office, Non-Final Office Action, U.S. Appl. No. 13/723,667, dated Mar, 13, 2014, 14 pages.
United States Patent and Trademark Office, Non-Final Office Action, U.S. Appl. No. 13/782,710, dated Apr. 11, 2014, 19 pages.
United States Patent and Trademark Office, Non-Final Office Action, U.S. Appl. No. 13/782,710, dated Mar. 2, 2015, 14 pages.
United States Patent and Trademark Office, Non-Final Office Action, U.S. Appl. No. 14/611,944, dated May 17, 2016, 19 pages.
United States Patent and Trademark Office, Notice of Allowance, U.S. Appl. No. 13/723,667, dated Oct. 17, 2014, 7 pages.
United States Patent and Trademark Office, Notice of Allowance, U.S. Appl. No. 13/782,710, dated Jun. 15, 2016, 10 pages.
United States Patent and Trademark Office, Non-Final Office Action, U.S. Appl. No. 14/611,944, dated Sep. 11, 2017, 16 pages.
United States Patent and Trademark Office, Notice of Allowance, U.S. Appl. No. 14/611,944, dated Apr. 6, 2018, 16 pages.

* cited by examiner

PROCESSOR-READABLE MEDIUM, APPARATUS AND METHOD FOR UPDATING HEARING AID

CROSS-REFERENCE TO RELATED APPLICATION(S)

This application is a continuation of 13/782,710, filed Mar. 1, 2013 (now U.S. Pat. No. 9,479,876), which is a non-provisional application of and claims priority to Provisional Application No. 61/621,234 filed on Apr. 6, 2012 and entitled "PROCESSOR-READABLE MEDIUM, APPARATUS AND METHOD FOR UPDATING A LISTENING DEVICE." The foregoing patent application are incorporated herein by reference in their entireties.

FIELD

This disclosure relates generally to hearing aids, and more particularly to hearing aids that are user adjustable.

BACKGROUND

Hearing deficiencies can range from partial hearing impairment to complete hearing loss. Often, an individual's hearing ability varies across the range of audible sound frequencies, and many individuals have hearing impairment with respect to only select acoustic frequencies. For example, an individual's hearing loss may be greater at higher frequencies than at lower frequencies.

A hearing health professional typically takes measurements using calibrated and specialized equipment to assess an individual's hearing capabilities in a variety of sound environments, and then adjusts the hearing aid based on the calibrated measurements. Subsequent adjustments to the hearing aid can require a second exam and further calibration by the hearing health professional, which can be costly and time intensive. In some instances, the hearing health professional may create multiple hearing profiles for the user for use in different sound environments.

However, merely providing stored hearing profiles to the user often leaves the user with a subpar hearing experience because each acoustic environment may vary in some way from the stored hearing aid profiles provided by the hearing health professional. Simply, storing more profiles on the hearing aid provides for better coverage of environmental systems but requires larger memories and increases the processing requirements in the hearing aid. Increased memory and enhanced processing increase the size requirements of the hearing aid that users want to be small and unobtrusive.

Some hearing aid systems allow the user to adjust their hearing aid after an initial programming by a hearing health professional by connecting the hearing aids to their personal computer (PC) and allowing the user to adjust the hearing aids while in use so that the user can hear the differences between each adjustment. However, while these hearing aid to PC systems allow for easier adjustments it is very difficult for a user to take into consideration acoustic environmental changes when adjusting a hearing aid because the home acoustic environment may be externally different form the intended use acoustic environment.

BRIEF DESCRIPTION OF THE DRAWINGS

In the following description, the use of the same reference numerals in different drawings indicates similar or identical items.

DETAILED DESCRIPTION OF ILLUSTRATIVE EMBODIMENTS

Embodiments of systems, hearing aids, computing devices, and methods are described below that allow for environmental simulation during programming of a hearing aid profile (sound-shaping profile) of a hearing aid. In an example, the hearing aid and the computing device communicate through a radio frequency communication channel, wirelessly, to exchange profile data and/or acoustic samples that can be used by one or both devices to simulate the experience of utilizing a hearing aid profile in an acoustic environment represented by the acoustic sample. The computing device can be any electronic device including a processor, a memory, and a transceiver for communicating data to a hearing aid through a wireless (radio frequency) communication channel.

Figure 1:
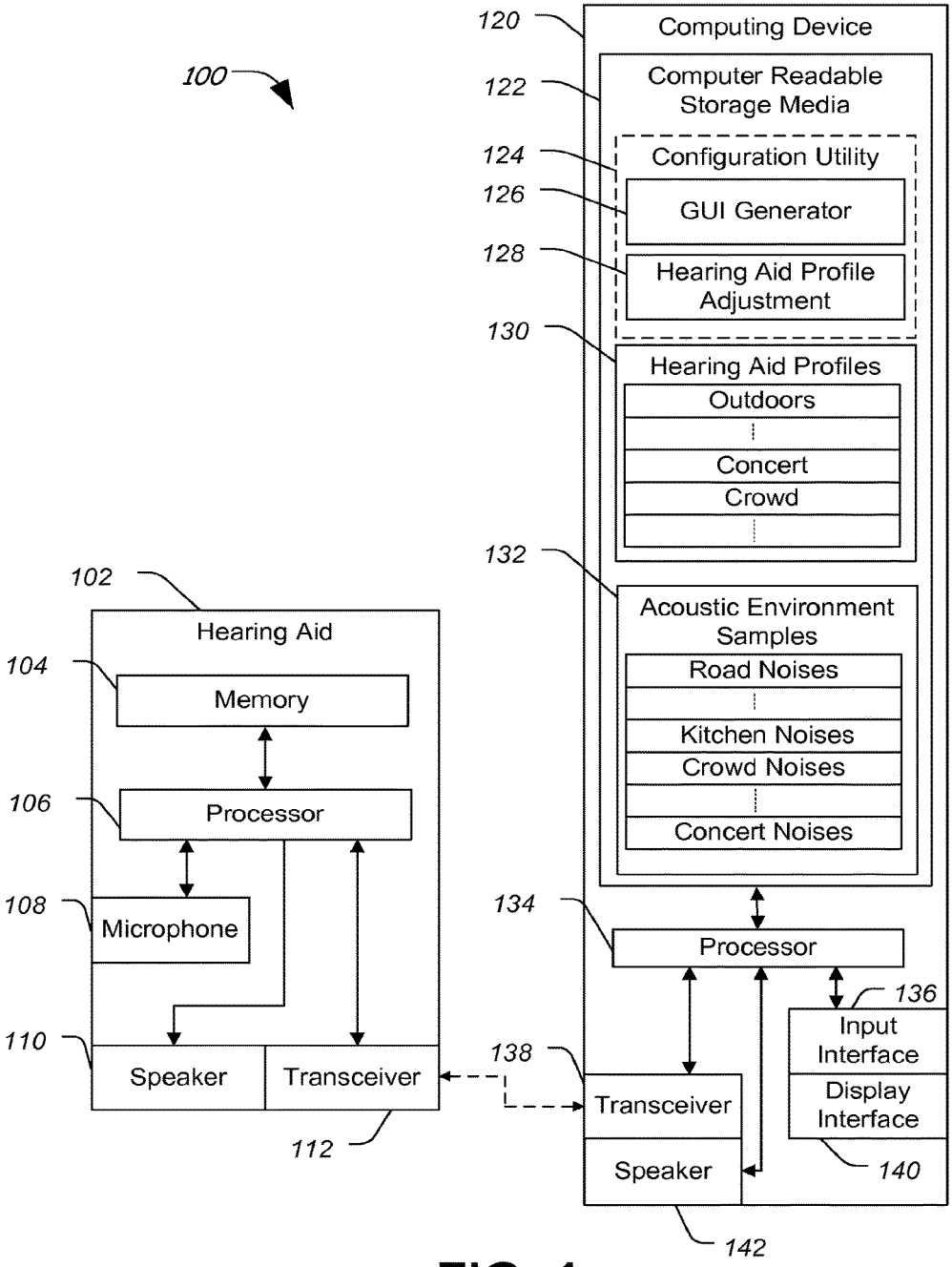
FIG. 1 is a block diagram of an embodiment of a hearing aid and a computing device adapted to provide user adjustment and acoustic environment simulation.

FIG. 1 is a block diagram of an embodiment of a hearing aid 102 and a computing device 120 adapted to provide user adjustment and acoustic environment simulation. Hearing aid 102 includes a transceiver 112 that is configured to communicate with computing device 120 through a communication channel. In some instances, the wireless communication channel can be a Bluetooth® communication channel. Hearing aid 102 also includes and microphone 108 to receive environmental noise or sounds and to convert the sounds into an audio signal and processor 106 for shaping an audio signal according to a hearing aid profile to produce a modified audio signal. Processor 106 is coupled to a speaker 110, which is configured to reproduce the modified audio signal as an audible sound at or within an ear canal of the user.

Computing device 120 is a personal digital assistant (PDA), smart phone, portable computer, or other computing device adapted to send and receive radio frequency signals according to any protocol compatible with hearing aid 102. One representative embodiment of computing device 120 includes the Apple iPhone®, which is commercially available from Apple, Inc. of Cupertino, Calif. or Blackberry®, available from Research In Motion Limited of Waterloo, Ontario. Other types of mobile telephone devices with short range wireless capability can also be used.

Computing device 120 includes computer-readable storage media 122, which is accessible by a processor 134. Computing device 120 further includes a transceiver 138, which is coupled to processor 134, such that processor 134 may send and receive data packets to and from transceiver 112 through transceiver 138. Computing device 120 also includes a display interface 140 and an input interface 136 to display information to a user and to receive user input, respectively. In some embodiments, a touch screen display may be used, in which case display interface 140 and input interface 136 are combined into a user interface.

Computer-readable storage media 122 stores a plurality of instructions that are executable by processor 134, including a configuration utility 124 with graphical user interface (GUI) generator instructions 126 and hearing aid profile adjustment instructions 128, a plurality of hearing aid profiles 130, and a plurality of acoustic environment samples 132. The acoustic environment samples are a collection of sounds representative of specific acoustic environments, such as a busy road, a park, a concert or other acoustic environment. Depending on the configuration of the computing device 120, the one or more computer-readable storage media 122 may be an example of non-transitory computer storage media and may include volatile and non-volatile memory and/or removable and non-removable media implemented in any type of technology for storage of information such as computer-readable instructions, data structures, program modules or other data. Such computer-readable media includes, but is not limited to, RAM, ROM, EEPROM, flash memory or other computer-readable media technology, CD-ROM, digital versatile disks (DVD) or other optical storage, magnetic cassettes, magnetic tape, solid state storage, magnetic disk storage, RAID storage systems, storage arrays, network attached storage, storage area networks, cloud storage, or any other medium that can be used to store information and which can be accessed by the processor 134 directly or through another computing device. Accordingly, the computer-readable storage media 122 may be computer-readable media able to maintain instructions, modules or components executable by the processor 134.

Additionally, computing device 120 includes speaker 142 for reproducing the acoustic environment samples as audible sound. In some instances, such as where computing device 120 is a portable computer, speaker 142 may be external to computing device 120 and coupled to an audio output interface of computing device 120.

The term "hearing aid profile" refers to a collection of acoustic configuration settings for hearing aid 102, which are used by processor 106 within hearing aid 102 to shape acoustic signals. Each of the hearing aid profiles of the plurality of hearing aid profiles 130 are based on the user's hearing characteristics and designed to compensate for the user's hearing loss or otherwise shape the sound received by microphone 108. Each hearing aid profile includes one or more parameters to shape or otherwise adjust sound signals for a particular acoustic environment. In particular, the one or more parameters are configurable to customize the sound shaping and to adjust the response characteristics of hearing aid 102, so that processor 106 can apply a customized hearing aid profile to a sound-related signal to compensate for hearing deficits of the user or otherwise enhance the sound-related signals. Such parameters can include signal amplitude and gain characteristics, signal processing algorithms, frequency response characteristics, coefficients associated with one or more signal processing algorithms, or any combination thereof.

In an embodiment, a user initiates a hearing aid profile configuration process by launching an application on computing device 120, which triggers configuration utility 124. Configuration utility 124 causes processor 134 to execute hearing aid profile adjustment instructions 128 and GUI generator instructions 126. GUI generating instructions 128 when executed cause processor 124 to display a user interface on display interface 140 and wait for user selections from input interface 136.

In one example, the user interface provides the user with a list representative of the plurality of hearing aid profiles 130, which the user may select to adjust. The user interface also provides a second representative list comprising the acoustic environment samples 132 for the user to select from while adjusting the selected hearing aid profile. Once the user selects a hearing aid profile from the representative list, hearing aid adjustment instructions 128 allow the user to make modifications to the sound shaping instruction included within the selected hearing aid profile to generate a modified hearing aid profile. In another example, the user may select to generate a new hearing aid profile and may utilize hearing aid adjustment instructions 128 to generate a hearing aid profile from scratch or from the stored values representative of their hearing loss.

Once a modified hearing aid profile has been generated and an acoustic environment samples has been selected, processor 134 provides the modified hearing aid profile to hearing aid 102 through the communication channel and the selected acoustic environment to speaker 142 for reproduction as audible sound. In this manner, the user is able to determine if the modified hearing aid profile is suitable to the acoustic environment represented by the acoustic environment sample without being in the actual acoustic environment. Thus the user may generate hearing aid profiles for specific acoustic environments in the comfort of their own home.

In an example, processor 134 may alternatively provide hearing aid 102 with the modified hearing aid profile and the original hearing aid profile in an iterative manner, while speaker 142 is reproducing the acoustic environment sample as sound, such that the user may hear the difference between the original and the modified profile.

In another example, once the acoustic environment sample is selected computing device 120 may begin to reproduce the sample as audible sound during the adjustment process and processor 134 may provide the adjustments to the selected hearing aid profile to hearing aid 102 in real time, such that the user may make an adjustment and then hear how the adjustment changed the sound shaping of the hearing aid profile as the user makes each individual adjustment.

It should also be understood, that multiple acoustic environment samples may be played simultaneously to provide an acoustic environment including two or more environments. For example, an acoustic sample of road noise may be played with an acoustic sample of a crowd to simulate a street full of automobiles and pedestrians.

In another embodiment once the modified hearing aid profile is generated, processor 134 applies both the modified hearing aid profile to the acoustic sample to generate a first adjusted acoustic sample and the original hearing aid profile to the acoustic sample to generate a second adjusted acoustic sample. The first and second adjusted acoustic samples are then provided to either speaker 142 or to hearing aid 102 for reproduction as audible sound without the need for further modification.

In yet another embodiment once the modified hearing aid profile is generated, both the modified hearing aid profile and the original hearing aid profile together with the selected acoustic environment are provided to hearing aid 102. Processor 106 of hearing aid 102 applies both the modified hearing aid profile and the original hearing aid profile to the selected acoustic environment to produce a first and second modified acoustic sample respectively. The first and second modified acoustic samples are provided iteratively to speaker 110 for reproduction as audible sound.

Figure 2:
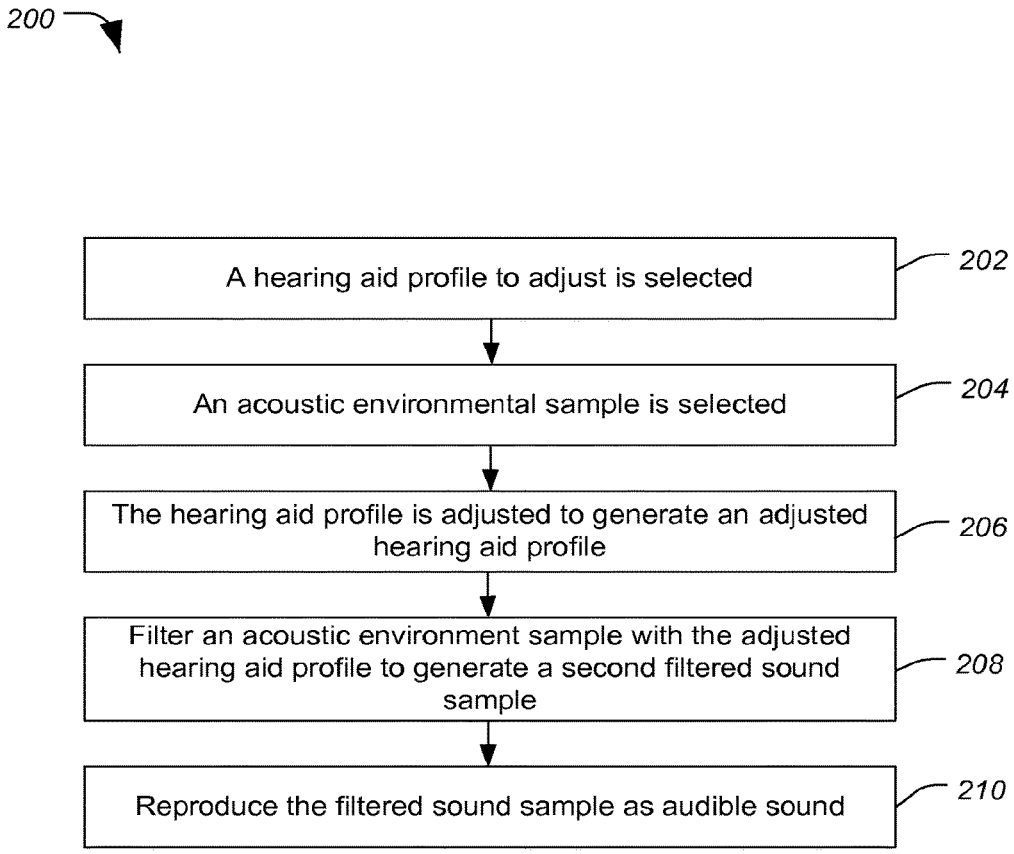
FIG. 2 is a flow diagram of the computing device of FIG. 1 that provides hearing aid profile adjustment and acoustic environment simulation.

FIG. 2 is a process flow diagram 200 of computing device 120 that provides hearing aid profile adjustment and acoustic environment simulation. At 202, a hearing aid profile to adjust is selected at computing device 120. Proceeding to 204, an acoustic environmental sample is selected at computing device 120 from the plurality of acoustic environmental samples 132.

Advancing to 206, the hearing aid profile is adjusted to generate an adjusted hearing aid profile. The hearing aid profile may be adjusted by the user via input interface 136 and display interface 140 or adjusted automatically by processor 134 executing hearing aid profile adjustment instructions 128. For example, hearing aid profile adjustment instruction 128 may cause processor 134 to apply the hearing aid profile to the acoustic environmental sample until the resulting sample's sound characteristics are within a predetermined threshold. In another example, hearing aid profile adjustment instruction 128 may cause processor 134 to determine sound characteristics of the acoustic environmental sample and by analyzing the user's hearing loss characteristics and the sound characteristics generating a suitable hearing aid profile.

Once the adjusted hearing aid profile is generated, method 200 proceeds to 208 and the acoustic environment sample is filtered with the adjusted hearing aid profile to generate a filtered sound sample. In one example, processor 134 of computing device 120 applies the adjusted hearing aid to the acoustic environmental sample to generate the filtered sound sample. In another example, the adjusted hearing aid profile and the acoustic environmental sample may be provided to hearing aid 102 and processor 106 applies the adjusted hearing aid profile to the acoustic environmental sample to generate the filtered sound sample. Proceeding to 212, the filtered sound sample is reproduced as audible sound, such that the user can determine what the adjusted hearing aid profile would sound like in the adjusted hearing aid profile's intended acoustic environment.

In an alternative method, the acoustic environment sample may also filtered with the hearing aid profile to generate a second filtered sound sample, which may be reproduced for the user in an alternating manner with the filtered sound sample. In this manner the user is able to determine the differences in operation between the hearing aid profile and the adjusted hearing aid profile as if the user was in the intended acoustic environment.

Figure 3:
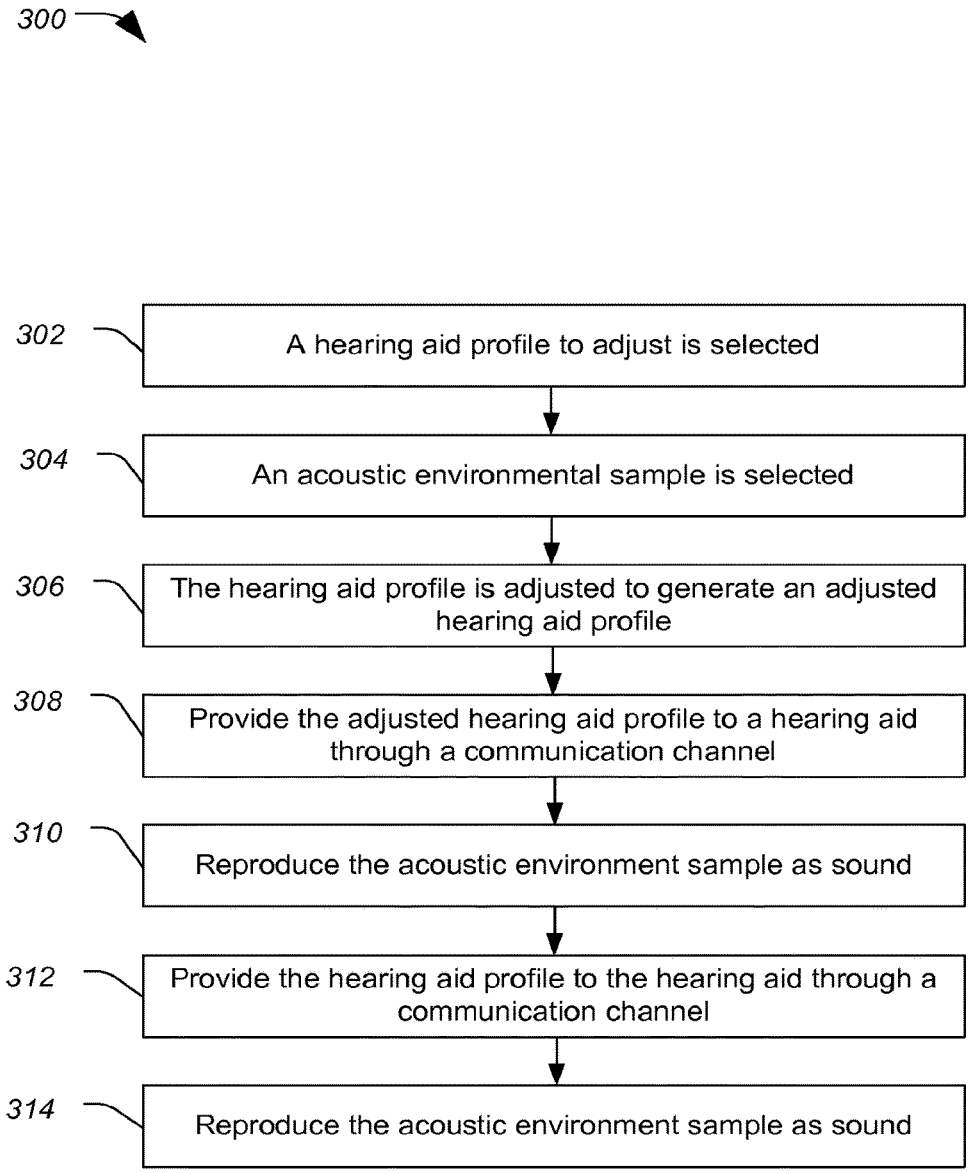
FIG. 3 is a second flow diagram of the computing device of FIG. 1 that provides hearing aid profile adjustment and acoustic environment simulation.

FIG. 3 is a second flow diagram 300 of computing device 120 that provides hearing aid profile adjustment and acoustic environment simulation. At 302, a hearing aid profile to adjust is selected at computing device 120. Proceeding to 304, an acoustic environmental sample is selected at computing device 120 from the plurality of acoustic environmental samples 132. Advancing to 306, the hearing aid profile is adjusted to generate an adjusted hearing aid profile.

Proceeding to 308, computing device 120 provides the adjusted hearing aid profile to hearing aid 102 through the communication channel. Hearing aid 102 is programmed to filter sound with the hearing aid profile provided by computing device 120, in this case the adjusted hearing aid profile. Moving to 310, computing device 120 reproduces the acoustic environmental sample as sound via speaker 142. Thus method 300 allows the user to simulate the acoustic environment represented by the acoustic environment sample in a realistic way. Method 300 does so by allowing hearing aid 102 to detect the sound (the reproduced acoustic environmental sample) at microphone 108 convert the sound to an audio signal (electrical signals) and processor 108 filtering the audio signal as dictated by the adjusted hearing aid profile to generate a filtered audio signal. The filtered audio signal is then provided to speaker 110 for reproduction as audible sound at the user's ear. By filtering the sound at hearing aid 102 and producing the sound at computing device 120, hearing aid 102 is able to filter sound as if the user was actually in the acoustic environment represented by the acoustic environmental sample.

In some cases method 300 continues to 312 and computing device 120 provides the hearing aid profile to hearing aid 102 through the communication channel, such that hearing aid 102 filters sounds using the original hearing aid profile instead of the adjusted hearing aid profile. Advancing to 314, computing device 120 reproduces the acoustic environment sample as sound once again, such that the user can compare the adjusted hearing aid profile with the original hearing aid profile. Method 300 may continue to alternate between providing the adjusted hearing aid profile and the original hearing aid profile to hearing aid 102 until computing device 120 receives a signal to stop. It should also be understood that as computing device 120 alternatively provides the adjusted hearing aid profile and the original hearing aid profile to hearing aid 102, computing device 120 may continuously reproduce the acoustic environmental sample as sound nonstop.

Although the present invention has been described with reference to preferred embodiments, workers skilled in the art will recognize that changes may be made in form and detail without departing from the scope of the invention.

What is claimed is:

1. A computer program product comprising a non-transitory computer readable storage medium storing computer usable program code executable to perform operations for adjusting a listening device profile, the operations comprising:

displaying a plurality of listening device profiles at a computing device, wherein each listening device profile corresponds to a different acoustic environment;

receiving a first user input at the computing device indicative of a selection of one of the listening device profiles;

receiving a second user input at the computing device indicative of a selection of a first acoustic environment of a first physical environment and a second acoustic environment of a second physical environment different than the first physical environment;

producing a simulated acoustic environment, wherein producing the simulated acoustic environment includes simultaneously outputting a first sound sample representative of the first acoustic environment and a second sound sample representative of the second acoustic environment in a third acoustic environment of a third physical environment, and wherein the third physical environment is different from the first and second physical environments;

adjusting at least one parameter of the selected listening device profile to generate an adjusted listening device profile associated with the simulated acoustic environment; and transmitting the adjusted listening device profile to a listening device.

2. The computer program product of claim 1 wherein producing the simulated acoustic environment further includes simultaneously outputting the first and second sound samples from the computing device, wherein the computing device is disposed in the third acoustic environment, and wherein the computing device is communicatively coupled to the listening device.

3. The computer program product of claim 1 wherein adjusting the at least one parameter of the selected listening device profile includes receiving a third user input at the computing device, and wherein the computing device is communicatively coupled to the listening device.

4. The computer program product of claim 1 wherein producing the simulated acoustic environment further includes simultaneously outputting the first and second sound samples in the third acoustic environment from one or more transducers disposed in the third acoustic environment, wherein the one or more transducers are operationally coupled to the computing device, and wherein the one or more transducers are external to the computing device.

5. The computer program product of claim 1 wherein producing the simulated acoustic environment further includes simultaneously outputting the first sound sample, the second sound sample and at least one other sound sample in the third acoustic environment, wherein the at least one other sound sample is representative of an acoustic environment different from the first, second and third acoustic environments.

6. The computer program product of claims 1 wherein the simulated acoustic environment is a first simulated acoustic environment, wherein the adjusted listening device profile is a first listening device profile, and wherein the operations further include operations for producing a second simulated acoustic environment, the operations including:

simultaneously outputting the first sound sample and a fourth sound sample representative of a fourth acoustic environment in the third acoustic environment, wherein the fourth acoustic environment is different from the first, second and third acoustic environments; and adjusting at least one parameter of a second listening device profile to generate a second adjusted listening device profile associated with the second simulated acoustic environment.

7. The computer program product of claim 1 wherein the simulated acoustic environment is a first simulated acoustic environment, and wherein the operations further include operations for producing a second simulated acoustic environment, the operations including:

applying the adjusted listening device profile to the first and second sound samples to generate first and second adjusted sound samples; and simultaneously outputting the first and second adjusted sound samples in the third acoustic environment.

8. The computer program product of claim 7 wherein the operations further include operations for repeating the applying and the simultaneous outputting until one or more characteristics of the second simulated acoustic environment are within a predetermined threshold.

9. A computer program product comprising a non-transitory computer readable storage medium storing computer usable program code executable to perform acts for simulating an acoustic environment, the acts comprising:

displaying a plurality of listening device profiles at a computing device, wherein each listening device profile corresponds to a different acoustic environment;

receiving a first operator input at the computing device indicative of a selection of one of the listening device profiles;

receiving a second operator input at the computing device indicative of a selection of a first sound sample and a second sound sample, wherein the first sound sample is representative of a first acoustic environment corresponding to a first physical environment, and wherein the second sound sample is representative of a second acoustic environment corresponding to a second physical environment different from the first physical environment;

simulating the acoustic environment by simultaneously outputting the first and second sound samples in a third acoustic environment corresponding to a third physical environment, wherein the first, second, and third physical environments are different from each other;

receiving a third operator input indicative of an adjustment of at least one sound-related parameter of the listening device profile;

generating an adjusted listening device profile corresponding to the simulated acoustic environment based, at least in part, on the received third operator input; and transmitting the adjusted listening device profile to a listening device.

10. The computer program product of claim 9, wherein the listening device is communicatively coupled to the computing device, and wherein simulating the simulated acoustic environment further includes simultaneously outputting the first and second sound samples from the computing device, wherein the computing device is disposed in the third acoustic environment.

11. The computer program product of claim 9, wherein the listening device is communicatively coupled to the computing device, wherein simulating the simulated acoustic environment further includes simultaneously outputting the first and second sound samples from at least one speaker disposed in the third acoustic environment, and wherein the at least one speaker is remote from the listening device and the computing device.

12. The computer program product of claim 9 wherein simulating the simulated acoustic environment further includes simultaneously outputting the first sound sample, the second sound sample and at least another sound sample in the third acoustic environment, wherein the at least another sound sample is representative of an acoustic environment different from the first, second and third acoustic environments.

13. The computer program product of claim 9 wherein the non-transitory computer readable storage medium further includes computer usable program code executable to perform acts comprising:

applying the adjusted listening device profile to the first and second sound samples to generate first and second adjusted sound samples; and simultaneously outputting the first and second adjusted sound samples in the third acoustic environment.

14. The computer program product of claim 13 wherein the non-transitory computer readable storage medium further includes computer usable program code executable to perform acts comprising:

receiving operator input indicative of an adjustment of at least one sound-related parameter of the adjusted listening device profile; and modifying the adjusted listening device profile based on the received operator input.

15. A computer program product comprising a non-transitory computer readable storage medium storing computer usable program code executable to perform acts for adjusting a listening device profile, the acts comprising:

displaying a plurality of listening device profiles at a computing device, wherein each listening device profile corresponds to a different acoustic environment;

receiving a first user input at the computing device indicative of a selection of one of the listening device profiles, wherein the selected listening device profile corresponds to a first acoustic environment;

receiving a second user input at the computing device indicative of a selection of a second acoustic environment and a third acoustic environment;

combining first and second sound samples representative of the second and third acoustic environments, respectively, to generate a third sound sample representative of the first acoustic environment, wherein the first, second, and third acoustic environments are different from each other;

determining one or more sound characteristics of the third sound sample; and adjusting the selected listening device profile corresponding to the first acoustic environment based, at least in part, on the one or more determined sound characteristics of the third sound sample and one or more predetermined values representative of a user's hearing characteristics.

16. The computer program product of claim 15 wherein the non-transitory computer readable storage medium further includes computer usable program code executable to perform acts comprising:

applying the listening device profile to the first and second sound samples to generate first and second adjusted sound samples;

simultaneously outputting the first and second adjusted sound samples in a fourth acoustic environment;

receiving user input indicative of an adjustment of at least one sound-related parameter of the listening device profile, and modifying the listening device profile based on the received user input.

* * * * *